US011173381B2

(12) United States Patent
Bartl et al.

(10) Patent No.: US 11,173,381 B2
(45) Date of Patent: Nov. 16, 2021

(54) FRONT JAW

(71) Applicant: MARKER Deutschland GmbH, Penzberg (DE)

(72) Inventors: Robert Bartl, Grainau (DE); Christian Brandl, Garmisch-Partenkirchen (DE)

(73) Assignee: MARKER DEUTSCHLAND GMBH, Penzberg (DE)

( * ) Notice: Subject to any disclaimer, the term of this patent is extended or adjusted under 35 U.S.C. 154(b) by 78 days.

(21) Appl. No.: 16/600,878

(22) Filed: Oct. 14, 2019

(65) Prior Publication Data

US 2020/0122016 A1 Apr. 23, 2020

(30) Foreign Application Priority Data

Oct. 15, 2018 (DE) ..... 10 2018 125 546.2

(51) Int. Cl.
*A63C 9/18* (2012.01)
*A63C 9/086* (2012.01)

(52) U.S. Cl.
CPC ..... *A63C 9/18* (2013.01); *A63C 9/086* (2013.01)

(58) Field of Classification Search
CPC ..... A63C 9/18; A63C 9/086
See application file for complete search history.

(56) References Cited

U.S. PATENT DOCUMENTS 3,490,781 A * 1/1970 Marker ..... A63C 9/08585 280/625
3,603,607 A * 9/1971 Marker ..... A63C 9/08564 280/625
4,907,817 A * 3/1990 Schwarz ..... A43B 5/0413 280/615
5,746,439 A * 5/1998 Boehm ..... A63C 9/003 280/602
8,936,252 B2 * 1/2015 Merino ..... A63C 9/0807 280/11.32
2011/0018232 A1 * 1/2011 Prigge ..... A63C 9/006 280/617
2014/0021696 A1 * 1/2014 Soldan ..... A63C 9/086 280/625
2015/0290524 A1 * 10/2015 Soldan ..... A63C 9/086 280/615

FOREIGN PATENT DOCUMENTS

EP 2826528 B1 10/2016

* cited by examiner

*Primary Examiner* — James A Shriver, II
*Assistant Examiner* — Michael T. Walsh
(74) *Attorney, Agent, or Firm* — RatnerPrestia

(57) ABSTRACT

The invention relates to a ski binding including a front jaw and a rear jaw for holding the sole of a ski boot. The front jaw includes a base, via which the front jaw can be connected to a ski, a first holding device for connecting the boot to the ski at the front end of the boot for ascending, and a second holding device for connecting the ski boot to the ski at the front end of the boot for descending. The second holding device exhibits a first configuration for descending, in which the second holding device is in contact with the front end of the sole of the ski boot, and a second configuration for ascending, in which the second holding device is out of contact with the front end of the sole of the ski boot.

16 Claims, 12 Drawing Sheets

FRONT JAW

CROSS-REFERENCE TO RELATED APPLICATIONS

This application claims priority to German Patent Application No. 10-2018-125546.2, filed Oct. 15, 2018, the contents of such application being incorporated by reference herein.

FIELD OF THE INVENTION

The invention relates to a ski binding which in a first arrangement, in which a front end of a ski boot is held in a first holding device, can be used for ascending in skis and in a second arrangement, in which the front end of the ski boot is held in a second holding device, can be used for downhill skiing. The second holding device can be detachably connected to the first holding device.

BACKGROUND OF THE INVENTION

Free-touring is now a popular sport in which the effort of ascending in skis is ideally combined with the pleasure of the subsequent descent in pristine terrain. In order to be able to safely execute the ascent and descent, more and more bindings are being offered which attempt a balancing act between as little weight as possible for the ascent and the necessary safety for the descent in deep snow.

EP 2 826 528 B1, which is incorporated by reference, for instance, discloses a combined touring and downhill binding comprising a first holding device, in which a front end of the ski boot is held for ascending, and a second holding device in which the front end of the ski boot is held for descending, wherein the lateral engaging elements of the first holding device which are necessary for ascending are arranged directly on the second holding device. The configuration can be varied between ascending and descending by pivoting the second holding device. In the configuration for ascending in particular, the weight of the integrated second holding device needlessly hampers ascending.

SUMMARY OF THE INVENTION

There is therefore a need for a generic ski binding which does not exhibit these drawbacks. An aspect of the application is a ski binding using which ascending and downhill skiing can be safely executed.

Advantageous developments of the ski binding are described in the claims and in the description.

One aspect of the invention relates to a ski binding, comprising: a front jaw for holding a front end of the sole of a ski boot; and a rear jaw for holding a rear end of the sole of a ski boot. When the ski boot is being held in the ski binding, the front end of the sole is arranged in front of the rear end of the sole in the skiing direction and points towards the tip of the ski.

The front jaw of the ski binding comprises a base, via which the front jaw can be connected to a ski, and a jaw body which is or can be connected to the base or is formed together with the base, for example originally molded in one piece with the base.

The front jaw comprises a first holding device using which a ski boot can be connected to the ski at the front end of the ski boot for ascending. This first holding device defines a joint axis about which the ski boot can be pivoted via its front end. The front jaw also comprises a second holding device using which the ski boot can be connected to the ski at the front end of the ski boot for descending, wherein the second holding device exhibits a first configuration for descending, in which the second holding device is in contact with the front end of the sole of the ski boot, and a second configuration for ascending, in which the second holding device is out of contact with the front end of the sole of the ski boot. In the first configuration for descending, the second holding device is coupled to the base and/or the first holding device; in the second configuration for ascending, the second holding device can be completely removed, in particular in one part, from the first holding device, i.e. the second holding device is embodied such that it can preferably be removed, preferably manually removed, in one piece from the base and/or the first holding device, for ascending in skis, wherein "manually" in this case describes removing by hand, substantially without using a tool, but for example with the aid of a ski pole.

The first holding device preferably comprises at least one first engaging element, preferably a first and a second engaging element, which can be moved from a first position, in which they have a first distance from each other, towards each other into a second position in which they have a second distance from each other which is smaller than the first distance. In the second position, the at least one first engaging element or the first engaging element engages with a first receptacle in the front end of the sole. The first receptacle can preferably be formed in a side wall of the front end of the sole, which extends substantially parallel to a longitudinal axis of the ski boot. In the second position, the second engaging element engages with a second receptacle in the front end of the sole, wherein the second receptacle is formed opposite the first receptacle in relation to a central axis of the ski boot in the longitudinal direction. The first engaging element, the first receptacle, the second engaging element and the second receptacle thus define the joint axis about which the ski boot can be pivoted.

The front jaw can also comprise a tensioning device which can move the first engaging element and the second engaging element into the second position and hold and/or secure them in the second position. The tensioning device can comprise a tensioning lever using which the tensioning device or a tensioning element of the tensioning device can be tensioned and relaxed or released, preferably manually or with the aid of a ski pole. If the tensioning device is tensioned, the tensioning lever is correspondingly situated in a second position; if the tensioning device is relaxed or released, it is situated in a first position.

The first holding device can be a holding device such as is for example used in a front jaw of a pin binding, comprising pins as the engaging elements which engage with the corresponding receptacles in the sole of the ski boot.

The second holding device can comprise a holding device body featuring: a first ski boot retainer which encompasses the front end of the sole at least laterally; and a second ski boot retainer which encompasses the front end of the sole of the ski boot at least laterally, wherein the first ski boot retainer and the second ski boot retainer can form contact areas which, in the first configuration for descending in skis, lie on a free surface of the front end of the sole of the ski boot and hold the ski boot down onto the ski, wherein the first ski boot retainer can be connected to the holding device body in a first ski boot retainer pivot joint and the second ski boot retainer can be connected to the holding device body in a second ski boot retainer pivot joint, wherein a pivot axis of the first ski boot retainer pivot joint and a pivot axis of the second ski boot retainer pivot joint are substantially perpendicular to the joint axis of the first holding device and perpendicular to a surface of the ski. A wire which is bent substantially in a U-shape can serve as the pivot axis of the first ski boot retainer pivot joint and the pivot axis of the second ski boot retainer pivot joint. The wire can be fitted through openings in the upper side of the holding device body, wherein the two open ends of the wire can grip and/or engage with or through an opening in the first ski boot retainer and second ski boot retainer which corresponds to this opening, in order to form the ski boot retainer pivot joints.

In general, it should be the case that the parts forming a joint can comprise sliding surfaces which are formed by subsequent machining or off-tool, wherein only one of the parts forming the joint or both parts forming the joint can comprise the sliding surface. The sliding surfaces can also be formed by separate parts, such as annular bodies, which are connected to a joint part during or after manufacture. Lastly, the possibility should also not be excluded of a joint comprising a bearing, such as a spherical bearing, needle bearing or barrel-shaped bearing, etc., which is then correspondingly shielded against the outside in order to reduce the risk of soiling from snow.

A spring element can tension the first ski boot retainer and the second ski boot retainer towards each other and in the process press them against the sides of the front end of the sole, when the ski binding is being used for descending.

Lastly, the second holding device can comprise a connecting device which connects the second holding device detachably, preferably manually detachably, to the base, the jaw body and/or the first holding device.

The connecting device can comprise a first connecting arm, which is rigidly connected to or formed by the holding device body, and a second connecting arm which is rigidly connected to or formed by the holding device body.

The first connecting arm and the second connecting arm can be arranged alongside each other in parallel or substantially in parallel and spaced from each other, wherein the first and second connecting arms can protrude from the holding device in the skiing direction.

The first connecting arm and the second connecting arm can each comprise a free end. The free ends of the connecting arms can have an engaging structure via which the connecting arms can co-operate with a complementary engaging structure which is formed on or comprised by the jaw body or the base, in order to form a pivot joint in which the second holding device is movably mounted on the base or jaw body, wherein the engaging structure can be connected, preferably manually, to the complementary engaging structure, and the engaging structure can be separated, preferably manually, from the engagement with the complementary engaging structure, such that—as already described above—the second holding device is embodied such that it can be removed manually or by hand from the front jaw. The engaging structure can be formed such that it can be connected to the complementary engaging structure in a positive fit and/or in a force fit. The complementary engaging structure can for example be a round rod onto which the engaging structure can be snapped, preferably manually. The engaging structure and the complementary engaging structure preferably form a connecting arm pivot joint or, respectively, two connecting arm pivot joints in which the second holding device can be pivoted relative to the base, wherein the round rod, or a rod having a polygonal, oval or otherwise shaped circumference, can be fixedly connected to the base or rotatably mounted in the base.

The second holding device has at least one receptacle opening with which a securing element can engage in order to fix the second holding device in the first configuration for descending in skis. The receptacle opening is preferably formed in a side of the second holding device which extends substantially parallel to the longitudinal axis of the ski. The receptacle opening can be arranged in front of the abutment of the holding device body for the front end of the sole and/or in front of the first and second ski boot retainers in the skiing direction.

The securing element is in particular at least one engaging element or the engaging element of the first holding device, wherein said engaging element can be tensioned by means of the tensioning lever and engages with the receptacle opening and secures the second holding device in the first configuration for descending in skis. If the first holding device is a pin binding, the second holding device can comprise exactly two receptacle openings with which the pins can engage, wherein the receptacle openings are arranged on the second holding device such that in the first configuration, they lie in the same position relative to each other as the receptacles for the pins of a sole of the ski boot which is designed to be held in a pin binding.

The second holding device can also comprise a securing device which is connected to the holding device body such that it can be pivoted in at least one securing device pivot joint and which fixes the second holding device in the second configuration. The at least one securing device pivot joint defines a joint axis which extends substantially parallel to the connecting arm pivot joint described above. In order to form the securing device pivot joint, the connecting arm can comprise an opening with which an axle element connected to or formed by the securing device engages, or an opening can be formed in the securing device, with which an axle element connected to or formed by the connecting arm engages. When connected to the holding device body, the securing element is preferably arranged in a space between the first connecting arm and the second connecting arm, i.e. the two connecting arms are substantially parallel to each other and spaced from each other, wherein each of the connecting arms comprises a connecting arm outer side and a connecting arm inner side, and the two connecting arm inner sides face each other. The space is therefore a space defined by a width of the connecting arm inner sides perpendicular to their longitudinal axis and their distance from each other and a length of the connecting arms. In a pivoted position, a front end or rear end (in the skiing direction) of the securing element can project out of the space.

The securing device can comprise at least one securing arm; preferably, the securing device comprises a first securing arm, a second securing arm and a securing plate which connects the first securing arm and the second securing arm to each other at one end. The securing element can be formed substantially in a U-shape, with the securing plate as the base. The securing arms project from the base substantially perpendicularly and taper from the base to the respective free end constantly or continuously and/or in stages or sections. Preferably, the securing device is originally molded in one piece, for example bent from sheet metal or produced in a molding process.

The free ends of the securing arms can be formed in the shape of hooks and, in order to secure the second holding device, their hook-shaped ends which each form an engagement can grip below the connecting arm pivot axis, so as to prevent the engaging structure of the free ends of the connecting arms, which is for example claw-shaped, from being able to release itself from the connection to the complementary engaging structure when the ski is for example exposed to hard impacts while descending.

The at least one securing arm or the first securing arm and/or second securing arm can also comprise a molded part which protrudes from the corresponding securing arm substantially at a right angle. The molded part protrudes from the side of the securing arm which faces the connecting arm when the securing device is connected to the connecting arm or arms of the second holding device, wherein the molded part can extend beyond the connecting arm, such that the molded part lies on the connecting arm when the second holding device is secured by means of the securing element.

The front jaw can also comprise a latching mechanism which latches the tensioning device when the second holding device is in the first configuration for descending in skis. The latching mechanism comprises at least one latching body, which forms an abutting area for the front end of the sole of the ski boot, and a spring element which biases the latching body into a release position.

When stepping into the binding—which is in the first configuration—wearing a ski boot, the front end of the sole comes into contact with the abutting area of the latching body and, in the subsequent course of stepping in, moves the latching body—against a force of the spring element—into the holding device body of the second holding device, into a latching position. The latching body is held in the latching position as long as the ski boot is held in the first configuration which is set for descending in skis. If the ski boot is removed from the binding, or the binding is adjusted from the first configuration to the second configuration, the latching body is automatically moved back into the release position by the force of the spring element, wherein a first axial end of the spring element can be supported on the holding device body and a second axial end of the spring element can be supported on the latching body. The spring element can be a compression spring, a tension spring, a leaf spring, an elastically deformable solid body, a gas or liquid piston or other spring element.

The latching body can comprise a stud which protrudes perpendicularly with respect to the longitudinal axis of the ski and acts on the tensioning device of the first holding device, in order to secure the tensioning device in the second position by preventing the tensioning device from able to be released as long as the ski binding is in the first configuration and a ski boot is being held in the ski binding. In order to secure the tensioning device in the tensioned position, the stud can for example engage with the tensioning device, abut an upper or lower side of the tensioning device, at least partially encompass the tensioning device, etc.

The front jaw can also comprise a bearing plate for a front part of the ski boot, on which a front region of the sole of the ski boot is placed when the ski boot is in the binding. The bearing plate can comprise a surface which is designed so that the sole of the ski boot can be released from the front jaw with no major friction when for example the ski binding or, respectively, the front jaw is laterally released. The bearing plate can be able to be moved transverse to the skiing direction in order to provide the ski boot with a freedom of movement transverse to the skiing direction before and during lateral release. Such bearing plates are known in the prior art, for which reason a detailed description is unnecessary.

The bearing plate can be adjusted into a first position and a second position via an adjusting mechanism using a tool. In the first position, the bearing plate is arranged in such a way relative to the front jaw that the binding can be used with a ski boot comprising a standardized classic downhill sole. In the second position of the bearing plate, the binding can be used for ascending and for descending in ski boots comprising a standardized touring sole.

A second aspect of the invention relates to a second holding device such as has been described on the preceding pages. The second holding device is arranged for being connected to the previously described first holding device.

In the following, aspects which have already been mentioned and other aspects are described in the form of claims. These aspects can substitute for claims or can be combined with one or more of the claims in order to enhance the subject-matter of the application.

Aspect 1. A ski binding, comprising: a front jaw (1) for holding a front end of the sole of a ski boot; and a rear jaw for holding a rear end of the sole of a ski boot, wherein the front jaw (1'; 1) comprises:

a base (2), via which the front jaw (1'; 1) can be connected to a ski;

a jaw body which is or can be connected to the base (2) or forms part of the base (2);

a first holding device (3) using which a ski boot can be connected to the ski at the front end of the ski boot for ascending, wherein the first holding device (3) defines a joint axis (A1) about which the ski boot can be pivoted via its front end; and a second holding device (4) using which the ski boot can be connected to the ski at the front end of the ski boot for descending, wherein the second holding device (4) exhibits a first configuration for descending, in which the second holding device (4) is in contact with the front end of the sole of the ski boot, and a second configuration for ascending, in which the second holding device (4) is out of contact with the front end of the sole of the ski boot, wherein, in the first configuration for descending, the second holding device (4) is coupled to the base (2) and/or the first holding device (3), wherein, in the second configuration for ascending, the second holding device (4) is embodied such that it can be completely removed from the base (2) and/or the first holding device (3).

Aspect 2. The ski binding according to Aspect 1, wherein, in the second configuration for ascending, the second holding device (4) is embodied such that it can be removed manually or by hand from the base (2) and/or the first holding device (3).

Aspect 3. The ski binding according to any one of the preceding aspects, wherein the first holding device (3) comprises at least one first engaging element, preferably a first and a second engaging element (31, 32), which can be moved from a first position, in which they have a first distance from each other, towards each other into a second position in which they have a second distance from each other which is smaller than the first distance.

Aspect 4. The ski binding according to the preceding aspect, wherein, in the second position, the at least one first engaging element or the first engaging element (31) engages with a first receptacle in the front end of the sole and the second engaging element (32) engages with a second receptacle in the front end of the sole, and wherein the first engaging element (31), the first receptacle, the second engaging element (32) and the second receptacle define the joint axis (A1).

Aspect 5. The ski binding according to any one of the preceding two aspects, wherein the first engaging element (31) and the second engaging element (32) can be moved into the second position and held in the second position by a tensioning device (5).

Aspect 6. The ski binding according to the preceding aspect, wherein the tensioning device (5) comprises a tensioning lever (51) using which the tensioning device (5) or a tensioning element (52) of the tensioning device (5) can be tensioned and relaxed.

Aspect 7. The ski binding according to any one of the preceding aspects, wherein the second holding device (4) comprises:

a holding device body (41);

a first ski boot retainer (44) which encompasses the front end of the sole at least laterally, wherein the first ski boot retainer (44) is connected to the holding device body (41) in a first pivot joint (S0);

a second ski boot retainer (43) which encompasses the front end of the sole at least laterally, wherein the second ski boot retainer (43) is connected to the holding device body (41) in a second pivot joint (S1);

at least one spring element (9) which tensions the first ski boot retainer (44) and the second ski boot retainer (43) towards each other; and at least one connecting device which detachably connects the second holding device (4) to the base (2) and/or the first holding device (3).

Aspect 8. The ski binding according to the preceding aspect, wherein the connecting device comprises a first connecting arm (45), which is rigidly connected to or formed by the holding device body (41), and a second connecting arm (46) which is rigidly connected to or formed by the holding device body (41), and the first connecting arm (45) and the second connecting arm (46) are arranged parallel to each other and spaced from each other.

Aspect 9. The ski binding according to the preceding aspect, wherein the first connecting arm (45) and the second connecting arm (46) protrude from the holding device body (41) in the skiing direction.

Aspect 10. The ski binding according to the preceding aspect, wherein a free end of the first connecting arm (45) and a free end of the second connecting arm (46) have an engaging structure (45*a*, 46*a*) via which the first connecting arm (45) and the second connecting arm (46) co-operate with a complementary engaging structure which is comprised by the base (2) or the jaw body, in order to detachably connect the second holding device (4) to the first holding device (3).

Aspect 11. The ski binding according to the preceding aspect, wherein the engaging structure (45*a*, 46*a*) and the complementary engaging structure form a pivot joint (S2, S3) in which the second holding device (4) can be movably mounted on the base (2) or the jaw body.

Aspect 12. The ski binding according to any one of the preceding two aspects, wherein the engaging structure (45*a*, 46*a*) can be connected manually or by hand to the complementary engaging structure and separated manually or by hand from the complementary engaging structure.

Aspect 13. The ski binding according to any one of the preceding five aspects, wherein the second holding device (4) has at least one receptacle opening (47) with which a securing element can engage in order to fix the second holding device (4) in the first configuration for descending.

Aspect 14. The ski binding according to the preceding aspect, wherein the receptacle opening (47) is formed in a side of the second holding device (4) which extends substantially parallel to the longitudinal axis (L) of the ski.

Aspect 15. The ski binding according to any one of the preceding two aspects, wherein the receptacle opening (47) is arranged in front of an abutment (42*a*) of the holding device body (41) for the front end of the sole in the skiing direction.

Aspect 16. The ski binding according to any one of the preceding three aspects, wherein the securing element is an engaging element (31, 32) of the first holding device (3).

Aspect 17. The ski binding according to any one of the preceding five aspects, wherein the second holding device (4) also comprises a securing device (6) which is connected to the holding device body (41) such that it can be pivoted in at least one pivot joint (S4, S5).

Aspect 18. The ski binding according to the preceding aspect, wherein a joint axis (A4, A5) which is defined by the at least one pivot joint (S4, S5) extends substantially in parallel at an offset with respect to a joint axis (A2, A3) which is defined by the pivot joint (S2, S3).

Aspect 19. The ski binding according to any one of the preceding two aspects, wherein the securing device (6) has at least one securing arm (61, 62).

Aspect 20. The ski binding according to any one of the preceding three aspects, wherein the securing device (6) comprises a first securing arm (61), a second securing arm (62) and a securing plate (63) which connects the first securing arm (61) and the second securing arm (62) to each other at one end.

Aspect 21. The ski binding according to any one of the preceding two aspects, wherein a free end of the at least one securing arm (61, 62) or a free end of the first securing arm (61) and the second securing arm (62) form an engagement (61*a*, 62*a*) which can preferably be connected to the complementary engaging structure of the base (2) or jaw body.

Aspect 22. The ski binding according to any one of the preceding five aspects, wherein the securing device (6) is connected to the second holding device (4) in a first pivot joint (S4) and in a second pivot joint (S4).

Aspect 23. The ski binding according to the preceding aspect, wherein the first pivot joint (S4) and the second pivot joint (S5) have a common pivot axis (A3, A4).

Aspect 24. The ski binding according to any one of the preceding two aspects, wherein the first pivot joint (S4) connects the first connecting arm (45) to the first securing arm (61), and the second pivot joint (S5) connects the second connecting arm (46) to the second securing arm (62).

Aspect 25. The ski binding according to any one of the preceding six aspects, wherein the at least one securing arm (61, 62) or the first securing arm (61) and/or the second securing arm (62) has/have an outwardly protruding molded part (64, 65) on a lower side facing the ski.

Aspect 26. The ski binding according to any one of the preceding ten aspects, wherein the securing device (6) is arranged between the first connecting arm (45) and the second connecting arm (46).

Aspect 27. The ski binding according to Aspect 7, wherein the tensioning lever (51) of the first holding device (3) in the ski binding comprising the first holding device (3) and the second holding device (4) is arranged in a region arranged between the first connecting arm (45) and the second connecting arm (46).

Aspect 28. The ski binding according to any one of the preceding aspects, wherein the front jaw (1) comprises a bearing plate (7) for a front part of the ski boot.

Aspect 29. The ski binding according to any one of the preceding aspects, wherein the front jaw (1) also comprises a latching element (8) which latches the tensioning device (5) in the second position when a ski boot is being held in the second holding device (4).

Aspect 30. The ski binding according to the preceding aspect, wherein the latching element (8) comprises an abutting area (83) which is contacted by a front side of the sole of the ski boot when stepping into the ski binding wearing a ski boot, and wherein the latching element (8) can be moved from a release position into a latching position when stepping in further in the skiing direction.

Aspect 31. The ski binding according to any one of the preceding two aspects, wherein a spring element (11) biases the latching element (8) into the release position, and the latching element (8) can be moved into the latching position against the force of the spring element (11).

Aspect 32. The ski binding according to any one of the preceding three aspects, wherein the latching element (8) comprises: a latching body (81); a stud (82) which protrudes from the latching body (81); the abutting area (83); and an area (84) which serves as a counter bearing for a spring element (11).

Aspect 33. The ski binding according to any one of the preceding four aspects, wherein when the latching element (8) is in the latching position, the stud (82) prevents the tensioning device (5) from being able to be moved from the second position into the first position.

Aspect 34. The ski binding according to any one of the preceding five aspects, wherein the latching element (8) is arranged between the first ski boot retainer (43) and the second ski boot retainer (44) and is preferably guided linearly in the holding device body (41).

Aspect 35. The ski binding according to any one of the preceding three aspects, wherein a second counter bearing of the spring element (11) is formed in the holding device body (41).

Aspect 36. A front jaw attachment for a ski binding, consisting of a second holding device (4) according to any one of Aspects 7 to 35.

Aspect 37. The front jaw attachment according to the preceding aspect, wherein the second holding device (4) is designed to be detachably connected to a first holding device (3) according to any one of Aspects 1 to 35.

BRIEF DESCRIPTION OF THE DRAWINGS

In the following, aspects of the invention are described in more detail on the basis of figures from example embodiments. Features essential to aspects of the invention which can only be gathered from the figures form part of the scope of the disclosure and can be adduced, individually or in combination, in order to advantageously develop the subject-matter of the application. The figures show.

DETAILED DESCRIPTION OF THE INVENTION

Figure 1:
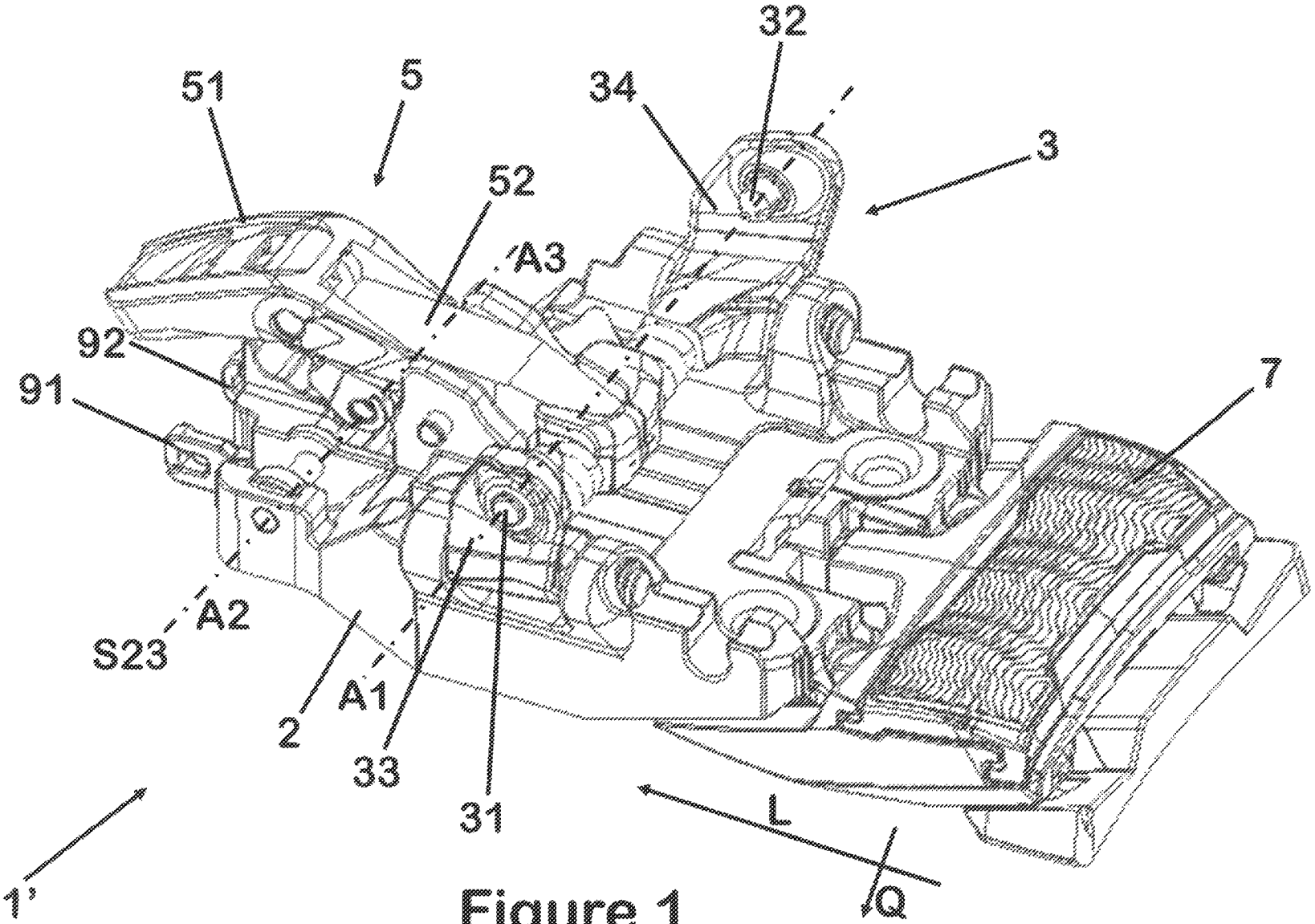
FIG. 1 a perspective view from above onto a front jaw which comprises a first holding device.

FIG. 1 shows a front jaw 1' of a ski binding, comprising: a base 2 for connecting the front jaw 1' to a ski boot; a first holding device 3 for holding a ski boot in the front jaw 1'; and a bearing plate 7 on which a lower side of a front sole of the ski boot being held in the front jaw 1' can be placed. The first holding device 3 comprises a tensioning device 5 using which a first engaging element 31 and a second engaging element 32 can be moved from a first position, in which the ski boot is released for stepping out of the front jaw 1', into a second position in which they hold the ski boot fixedly in the front jaw 1'.

As shown in the example embodiment, the first holding device 3 can be part of the front jaw of a pin binding, wherein the engaging elements 31, 32 are the pins which are connected in a known way to the tensioning device 5, which comprises a tensioning lever 51 and a tensioning element 52, via lever arms 33, 34. The first engaging element 31 and the second engaging element 32 can be moved by means of the tensioning device 5 towards each other into the second position and fixed in the second position in order to hold the ski boot, and the two engaging elements 31, 32 can be moved by means of the tensioning device 5 away from each other into the first position and fixed in the first position, where "fixed" is intended to mean that the engaging elements 31, 32 cannot be moved out of the first or, respectively, second position without employing an additional force which is greater than for example a force of gravity of the parts to be moved. In the configuration for ascending, the tensioning device 5 is latched in a known way by actuating the tensioning lever 51, i.e. by moving the tensioning lever 51 for example in a direction away from a surface of the ski.

The bearing plate 7 is a known bearing plate which can be adjusted in a longitudinal direction L of the ski using a tool, in order to set the front jaw such that it can be used independently of the sole of the ski boot, i.e. used with a standardized downhill sole of the ski boot or a standardized touring sole of the ski boot or a sole of the ski boot which fulfills the standards for the downhill sole of the ski boot and the touring sole of the ski boot or, respectively, with the ski boot comprising the corresponding sole of the ski boot. The bearing plate 7 can be able to be moved in a direction Q transverse to the longitudinal direction L of the ski, in order not to obstruct the release movement when the front jaw is laterally released while descending in skis. Alternatively or additionally, the bearing plate 7 can comprise a surface which assists a sole of the ski boot in sliding in the event of lateral release by reducing a friction resistance between the lower side of the sole of the ski boot and the upper side of the bearing plate 7.

Figure 2:
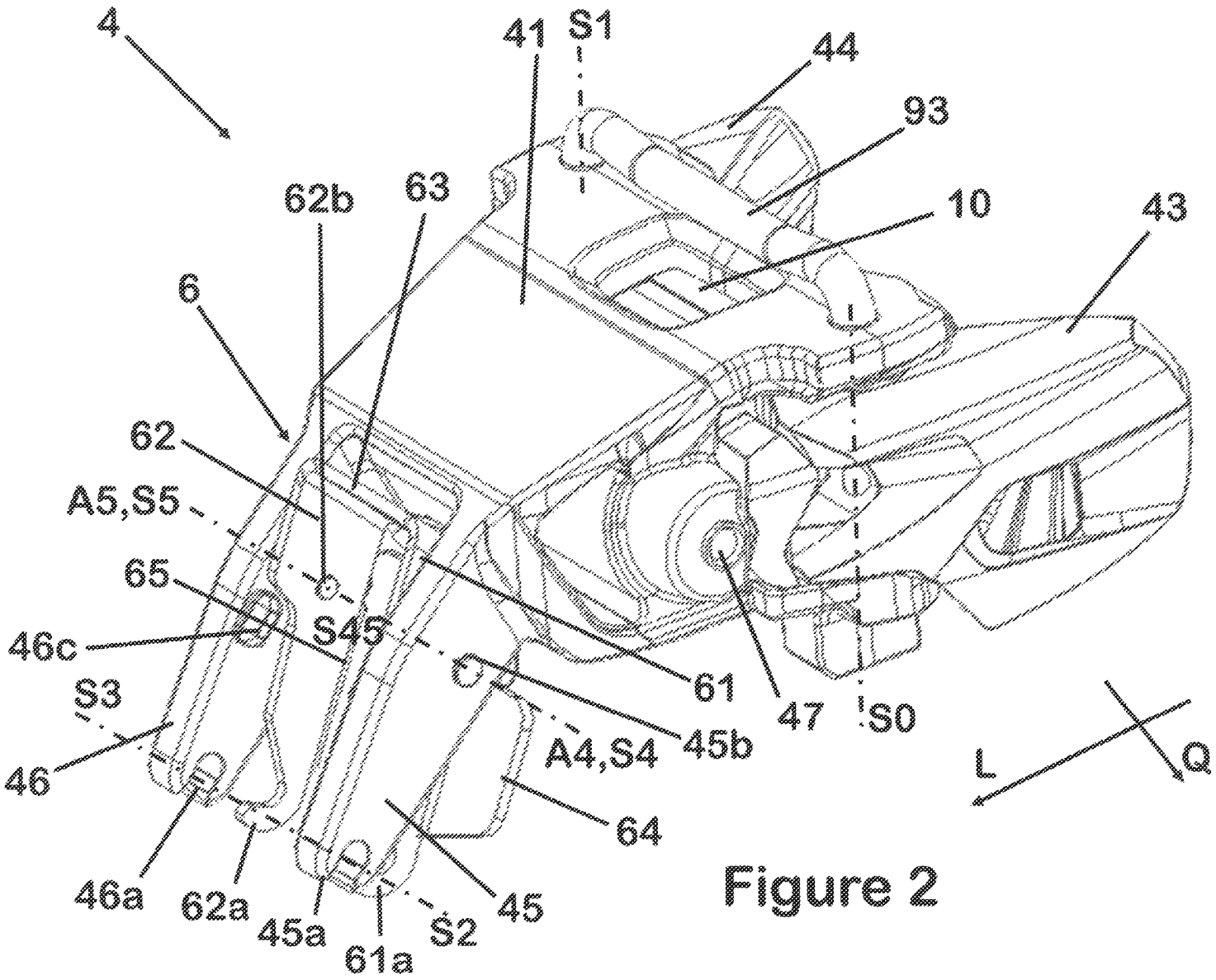
FIG. 2 a perspective view from the side onto a second holding device.
Figure 3:
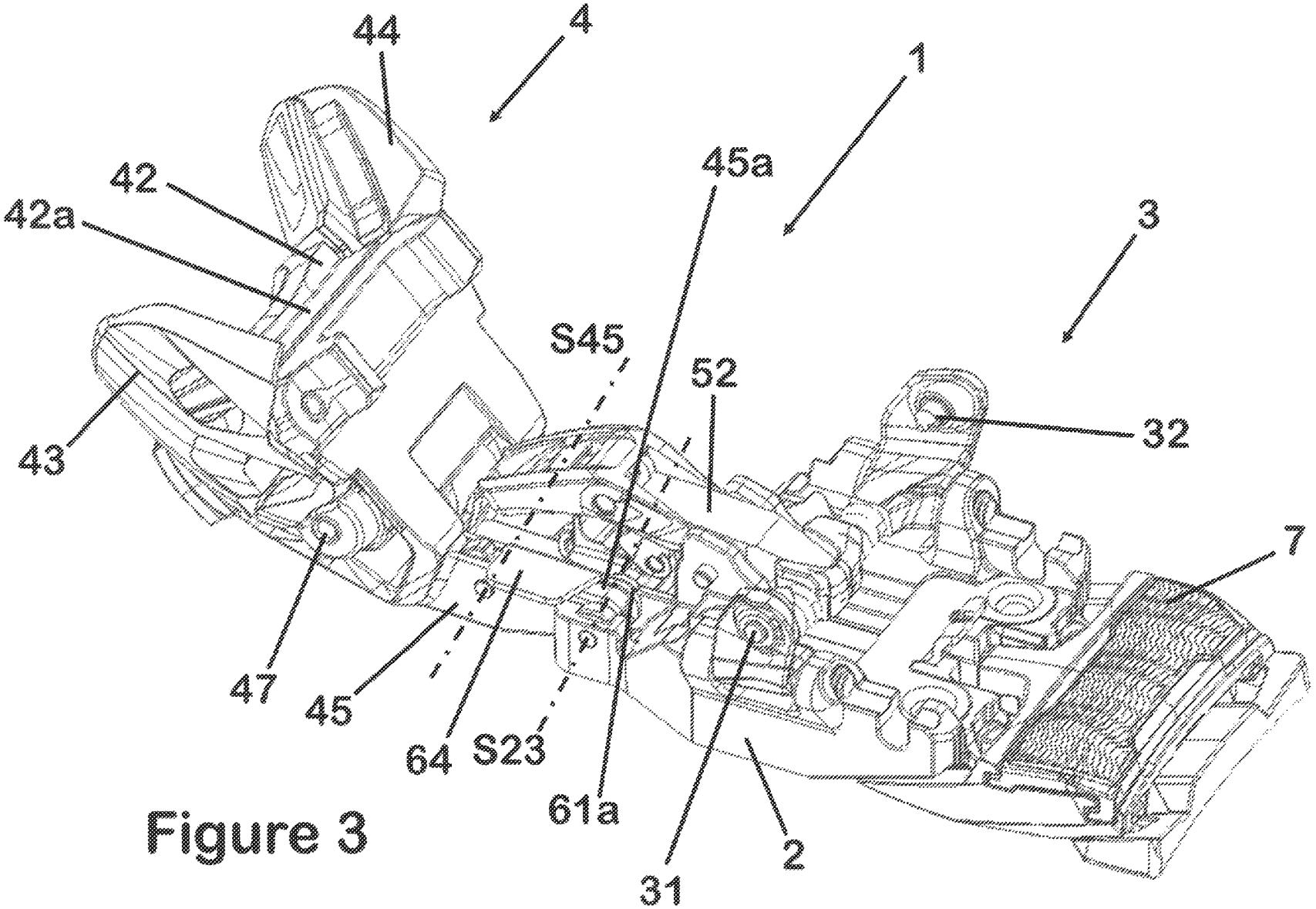
FIG. 3 a front jaw comprising the first holding device and the second holding device combined in a configuration for ascending.

In the region of the front jaw 1' which is a front region in the skiing direction, a joint axis A2 can be seen which, together with a joint axis A3 which is arranged on the other side of the front jaw 1' and cannot be seen in FIG. 1, forms a pivot axis S23, the significance of which is clarified in FIG. 2. In front of the pivot axis S23, holding elements 91, 92 can be seen which can latch a second holding device 4 (FIG. 2) in a position pivoted away from the first holding device 3, as shown in FIG. 3.

FIG. 2 shows a second holding device 4 for the front end of the ski boot, in a front jaw 1 which is formed from the front jaw 1' and the second holding device 4. The second holding device 4 is a part which is separate from the first holding device 3 and independent of the front jaw 1' and which can for example be carried along by the ski tourer in a rucksack in order to be connected later to the front jaw 1', so as to form the front jaw 1, for descending.

The second holding device 4 comprises a holding device body 41 featuring a first ski boot retainer 43 and a second ski boot retainer 44, which at least partially encompass the front end of the sole of the ski boot, and a first connecting arm 45 and a second connecting arm 46 which are designed to connect—preferably, detachably connect—the second holding device 4 to the first holding device 3 of FIG. 1.

The first connecting arm 45 and the second connecting arm 46 comprise an engaging structure 45*a*, 46*a*—in the example embodiment, a claw-shaped engaging structure—via which the second holding device 4 can be connected to the first holding device 3 in a positive fit, by snapping the engaging structure 45*a*, 46*a* of the second holding device 4 onto the joint axes A2 and A3, respectively. The connection between the joint axis A2 and the engaging structure 45*a* then forms a pivot joint S2, and the connection between the joint axis A3 and the engaging structure 46*a* then forms a pivot joint S3. Since the joint axes A2 and A3 form a common pivot axis S23 (FIG. 1) for the second holding device 4, the second holding device 4 can be pivoted about this common pivot axis S23 relative to the first holding device 3 and in particular pivoted onto and away from the first holding device 3.

A securing device 6 is connected to the connecting arms 45, 46. The securing device 6 comprises a first securing arm 61 and a second securing arm 62 and a securing plate 63 which connects the first securing arm 61 and the second securing arm 62 at one end, such that the securing device 6 is substantially U-shaped. The closed end of the U faces the holding device body 41; the open ends, which form an engagement 61*a*, 62*a* of the first securing arm 61 and second securing arm 62, are hook-shaped. The securing device 6 and the holding device body 41 are connected to each other, such that they can be pivoted. To this end, the first connecting arm 45 comprises a transit opening 45*b*, and the first securing arm 61 comprises a transit opening which is not visible. A joint axis A4 extends through the two transit openings 45*b* and forms part of a pivot joint S4. The second connecting arm 46 has a transit opening 46*b*, and the second securing arm 62 has a transit opening 62*b*, through which a joint axis A5 protrudes in order to form a pivot joint S5. The pivot joint S4 and the pivot joint S5 form a common pivot axis S45, about which the securing device 6 can be pivoted relative to the holding device body 41. In the example embodiment, the securing device 6 is arranged between the first connecting arm 45 and the second connecting arm 46.

The pivot axis S45 is arranged between the pivot axis S23 and the securing plate 63, nearer to the securing plate 63 in the example embodiment.

If the second holding device 4 is pivoted completely onto the first holding device 3, the securing device 6 secures the second holding device 4 in this position, in that the engagements 61*a*, 62*a* of the securing arms 61, 62 grip below the joint axes A2, A3 (FIG. 1) and thus prevent the engaging structure 45*a*, 46*a* of the connecting arms 45, 46, which is claw-shaped in the example embodiment, from being able to unintentionally detach from the joint axes A2, A3, for example due to the effect of impact forces when descending in uneven terrain.

The securing device 6 or, respectively, the first securing arm 61 and the second connecting arm 46 also comprise(s) molded parts 64, 65 which protrude from one of the longitudinal sides of the first securing arm 61 and second securing arm 62 at an angle of substantially 90°. The molded part 64 protrudes from the first securing arm 61 towards the first connecting arm 45 and, in the example embodiment, has a length transverse to the longitudinal axis L of the ski which is greater than a thickness of the first connecting arm 45. The same correspondingly applies to the molded part 65.

Lastly, the first connecting arm 45 preferably comprises a complementary holding element, which cannot be seen in this view, and the second connecting arm 46 preferably comprises a complementary holding element 46*c* which can co-operate with the holding elements 91, 92 (FIG. 1) formed on the end of the first holding device 3 which is the front end in the skiing direction, in order to secure the second holding device 4 in a position pivoted away from the first holding device 3, for example for ascending.

The first ski boot retainer 43 is connected to the holding device body 41 in a pivot joint S0, and the second ski boot retainer 44 is connected to the holding device body 41 in a pivot joint S1. A spring element 9 (see FIG. 6) tensions the two ski boot retainers 43, 44 towards each other in a known way, such that the two ski boot retainers 43, 44 are pressed laterally against the sole of the ski boot via the front jaw 1 when descending, wherein they encompass the sole of the ski boot from above and/or laterally at a front end and thus secure the ski boot in the ski binding. The force of the spring element 9 can be set in a known way, and the binding hardness set can be read off in a window 10 in the holding device body 41. In the example embodiment, a U-shaped wire 93 forms the joint axes for the pivot joint S0 and the pivot joint S1, wherein the wire 93 or, respectively, the two open ends of the wire 93 is/are fitted from above through openings in the holding device body 41 and through the ski boot retainers 43, 44. In the position in which it forms the pivot axes for the ski boot retainers 43, 44, the wire 93 is secured in the holding device body 41 in a positive fit and/or force fit against unintentionally working its way out.

The second holding device 4 also comprises a receptacle 47, with which the engaging element 31 of the first holding device 3 engages, and a receptacle which is not visible and with which the engaging element 32 of the first holding device 3 engages when the front jaw 1 is used in the downhill mode. The engagement between the engaging elements 31, 32 and the receptacles 47 secures the second holding device 4 against being unintentionally released. To this end, and as when securing the first holding device 3, the first engaging element 31 and the second engaging element 32 are tensioned towards each other using the tensioning lever 51. This means that when the front jaw 1 is in the position for descending, the receptacles 47 must lie in exactly the same position relative to the first holding device 3 as the position in which the openings are situated in the sole of the ski boot for the pins 31, 32 when the front jaw 1' of FIG. 1 is used for ascending.

FIG. 3 shows a front jaw 1 comprising the first holding device 3 and the second holding device 4 which is pivoted away from the first holding device 3 but connected to the first holding device 3. In this configuration, the front jaw 1 can be used for ascending. In order that the second holding device 4 does not unintentionally pivot towards the first holding device 3 in the process, the complementary holding elements 46*c* engage with the holding elements 91, 92 in order to detachably hold the second holding device 4 in the position shown and secure it against being unintentionally released.

In this position, an abutting area 42*a* can be seen which a front end of the sole of the ski boot abuts when the ski boot is held in the binding designed for descending (FIG. 4), as well as a contact area 42 via which the ski boot retainer 44 lies on a free surface of a front end of the sole of the ski boot when the ski boot or, respectively, its front end is held in the second holding device 4 for descending.

Figure 4:
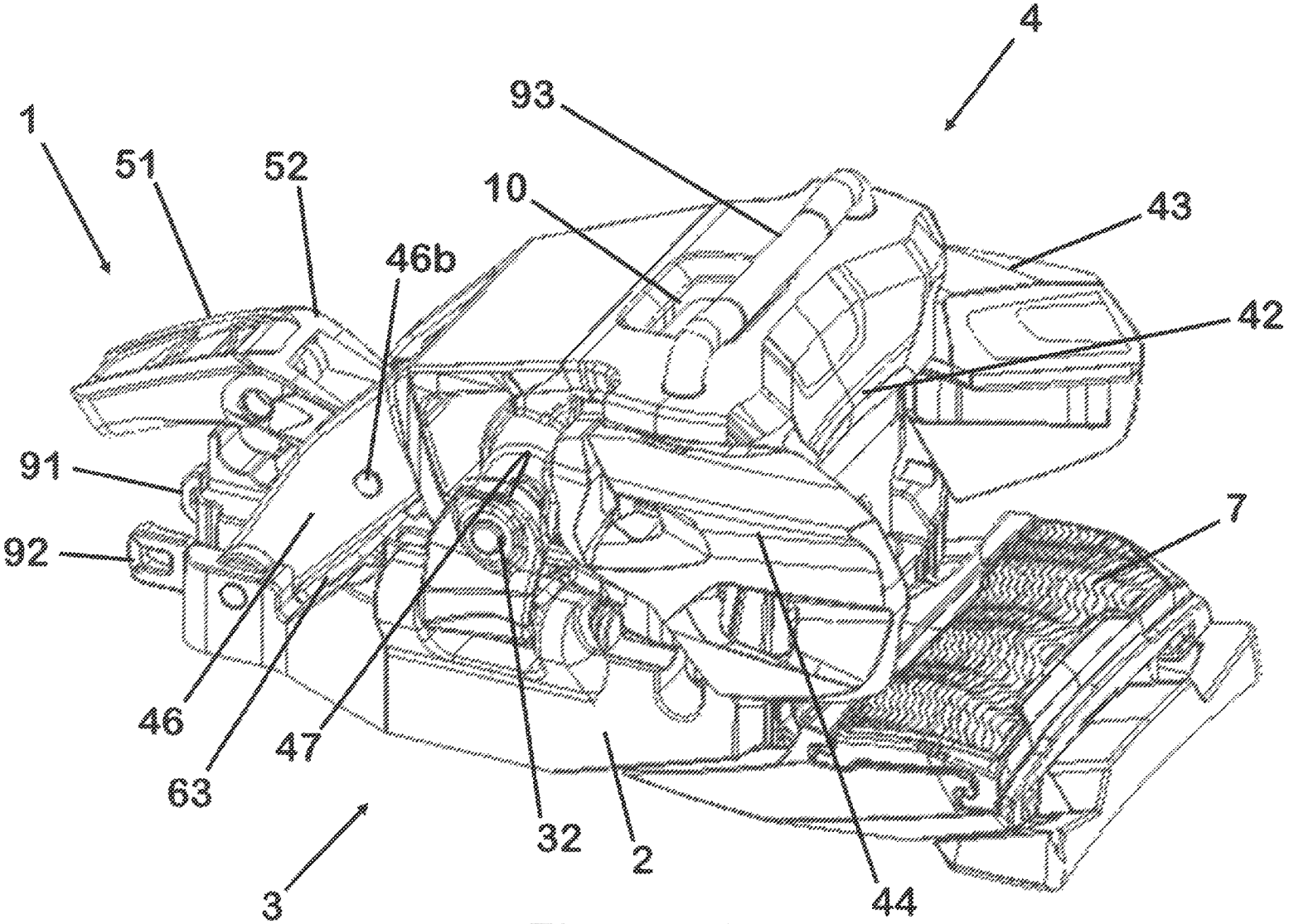
FIG. 4 a front jaw comprising the first holding device and the second holding device in a configuration for descending.

FIG. 4 shows the front jaw 1 in a configuration in which the front jaw 1 is ready to receive a ski boot for descending. The second holding device 4 is pivoted completely onto the first holding device 3, and the engaging elements 31, 32 of the first holding device 3 engage with the receptacles 47 on the second holding device 4 and thus secure the second holding device 4, in its position pivoted onto the first holding device 3, against being unintentionally released.

Figure 5:
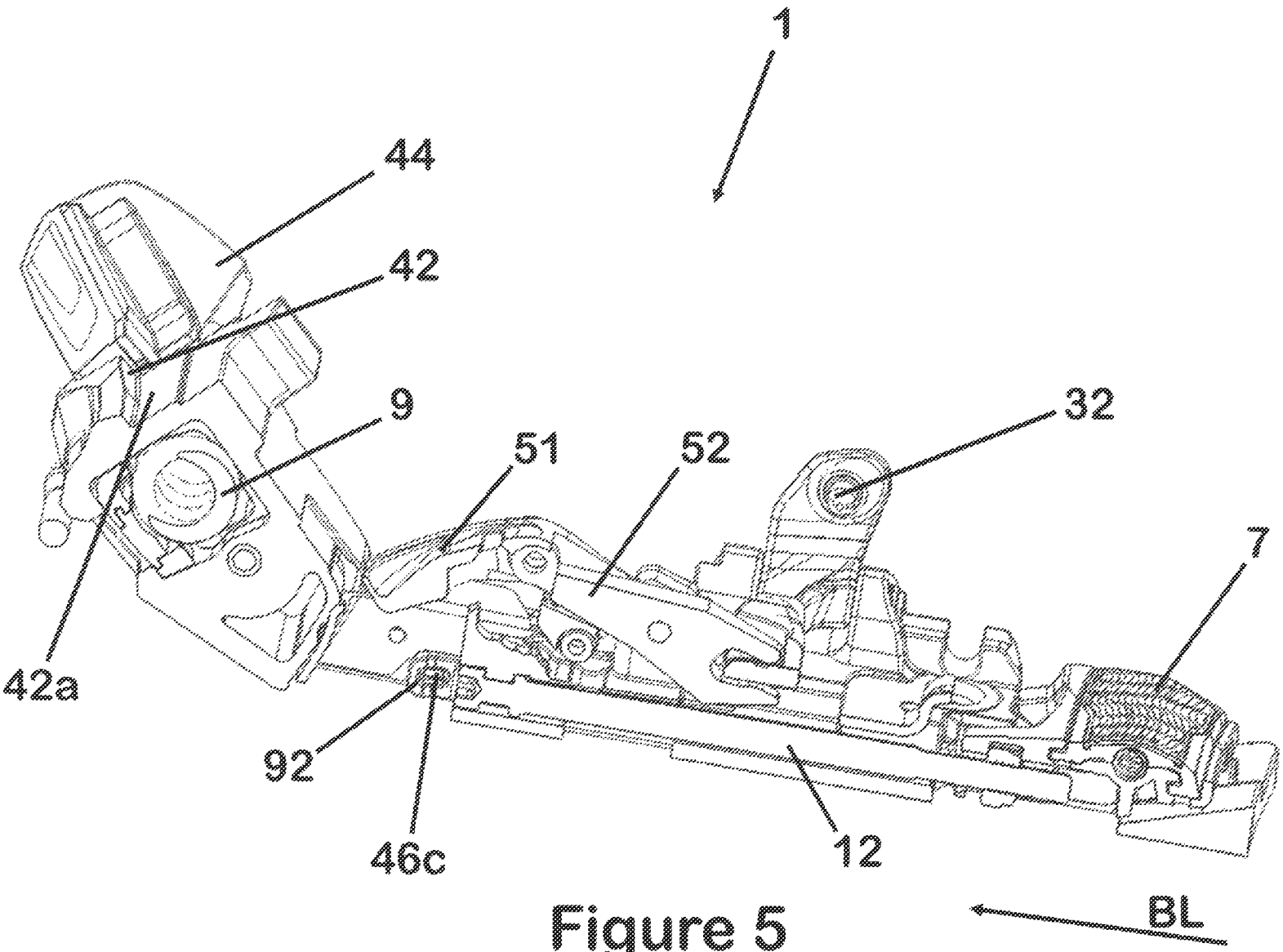
FIG. 5 a sectional view in the longitudinal direction of the front jaw of FIG. 3.

FIG. 5 shows a section through the front jaw 1 of FIG. 4 along a central longitudinal axis BL of the binding. The spring element 9, which acts on the first ski boot retainer 43 and the second ski boot retainer 44 in order to press the ski boot retainers 43, 44 against the sole of the ski boot, can be seen for the first time here. The holding element 92, which co-operates with the complementary holding element 46*c* in order to secure the second holding device 4 in the position in which it is connected to and pivoted away from the first holding device 3, can also clearly be seen. The sectional view also shows an adjusting element 12, using which the bearing plate 7 can be adjusted with the aid of a tool.

Figure 6:
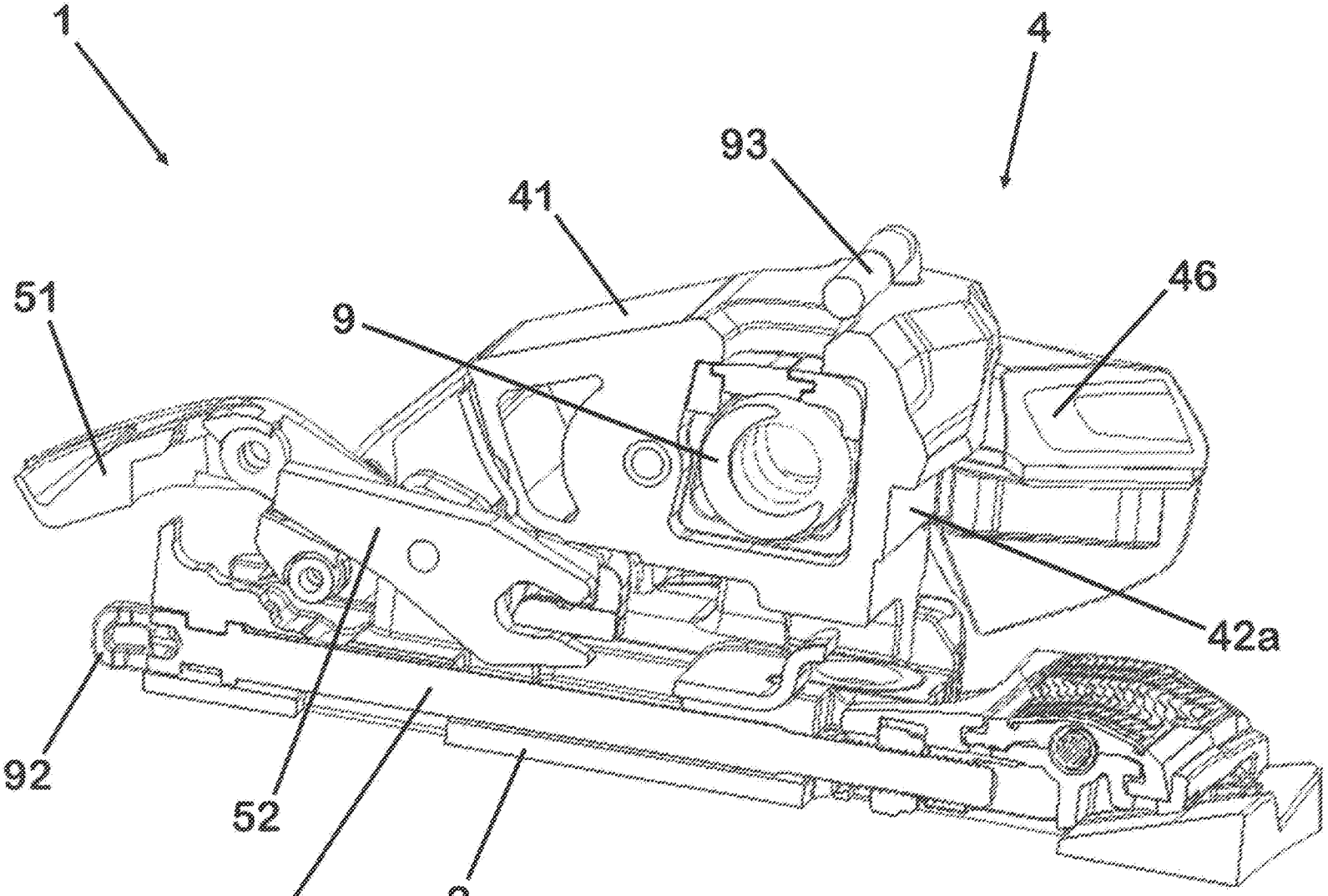
FIG. 6 a sectional view in the longitudinal direction of the front jaw of FIG. 4.

FIG. 6 shows another section through the front jaw 1, wherein, in this case, the second holding device 4 is pivoted completely onto the first holding device 3 and the engaging elements 31, 32 of the first holding device 3 are engaging with the receptacles 47 of the second holding device 4, as shown by the tensioned tensioning device 5. The abutting area 42*a*, which the front end of the sole of a ski boot held in the front jaw 1 abuts, is clearly shown here. In order that the engaging elements 31, 32 are not unintentionally released from the receptacles 47 in the configuration for descending, it is additionally necessary in the example embodiment shown to latch the engaging elements 31, 32 in the second position by actuating the tensioning lever 51, i.e. by moving the tensioning lever 51 away from the surface of the ski.

Figure 7:
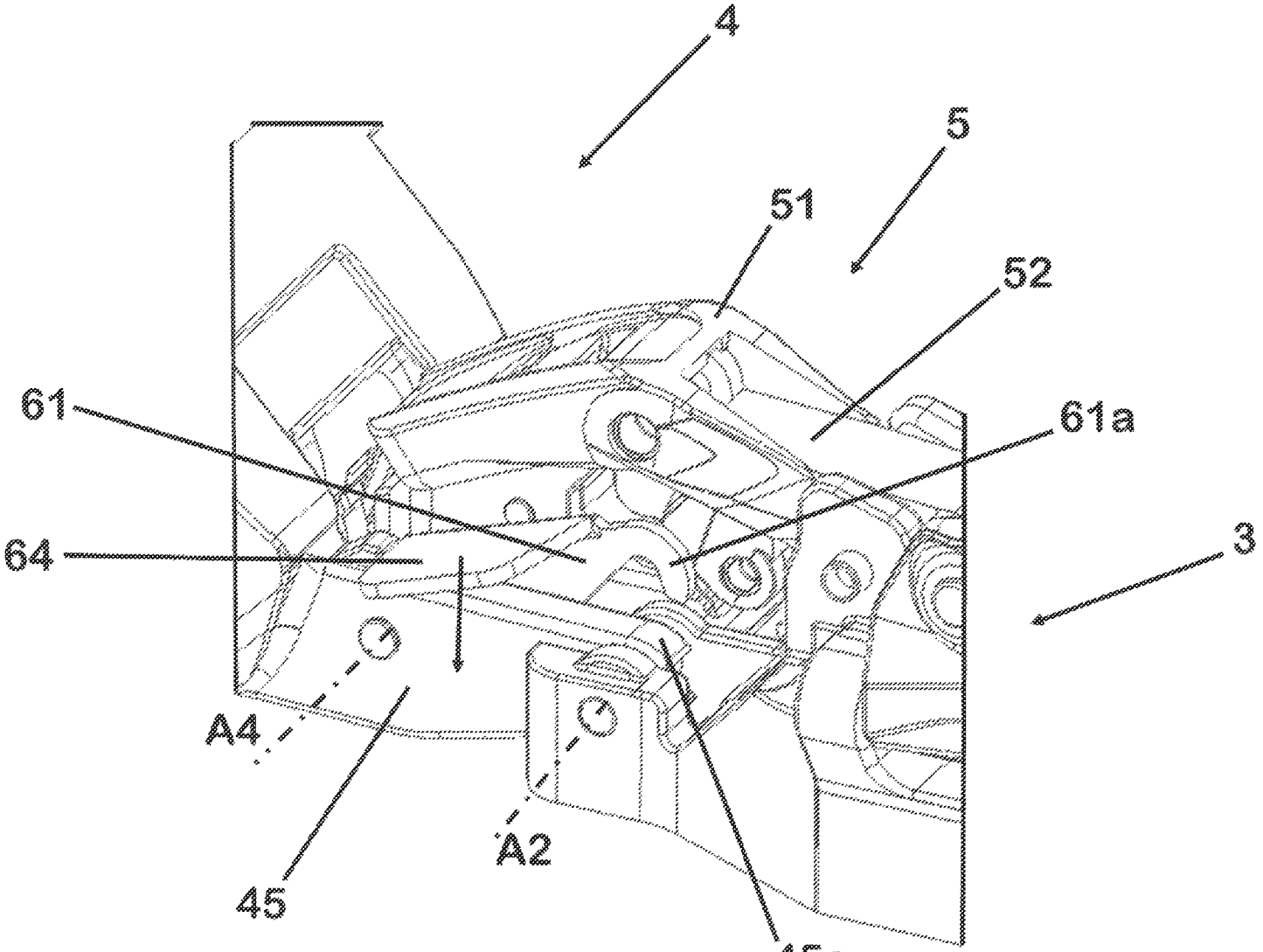
FIG. 7 a detailed view in the connecting region of the two holding devices.

FIG. 7 shows a detailed view of the securing device 6 shortly before it is closed or shortly after it is opened. The second holding device 4 encompasses the joint axis A1, A2 and thus connects the second holding device 4 to the first holding device 3 in a positive fit. In order to prevent this positive-fit connection from being unintentionally released, the securing device 6 is then pressed in the direction of the arrow, such that the hook-shaped free end 61*a* of the securing arm 61 partially encompasses or grips below the joint axis A2 and thus prevents the second holding device 4 from being able to detach from the joint axis A2. In order to close the securing device 6, pressure is exerted on the molded part 64 manually or for example by means of the tip of a ski pole. In order to release the securing device 6 before separating the second holding device 4 from the first holding device 3, the reverse procedure is performed.

Figure 8:
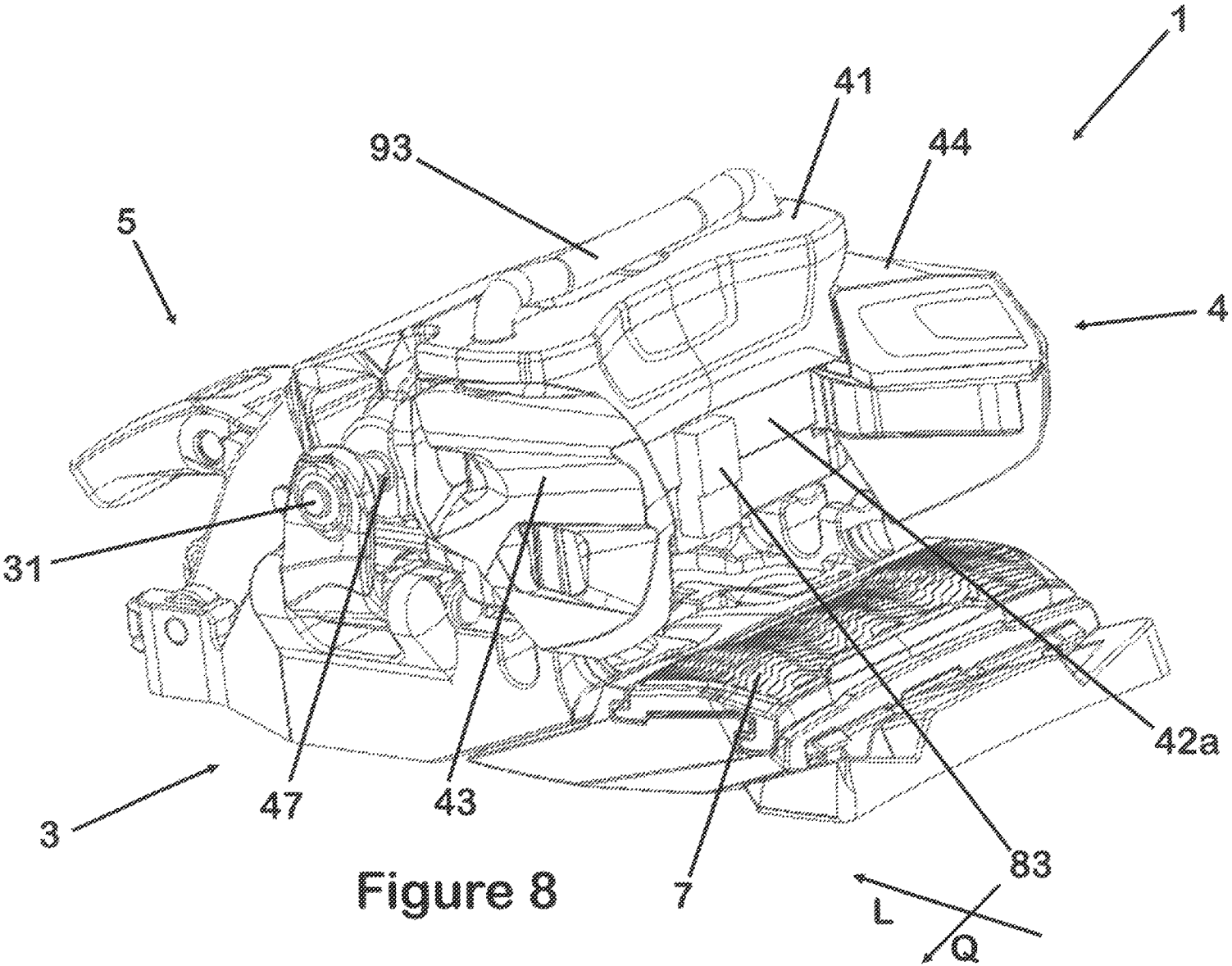
FIG. 8 an alternative front jaw comprising a first and second holding device and an additional latching element.
Figure 9:
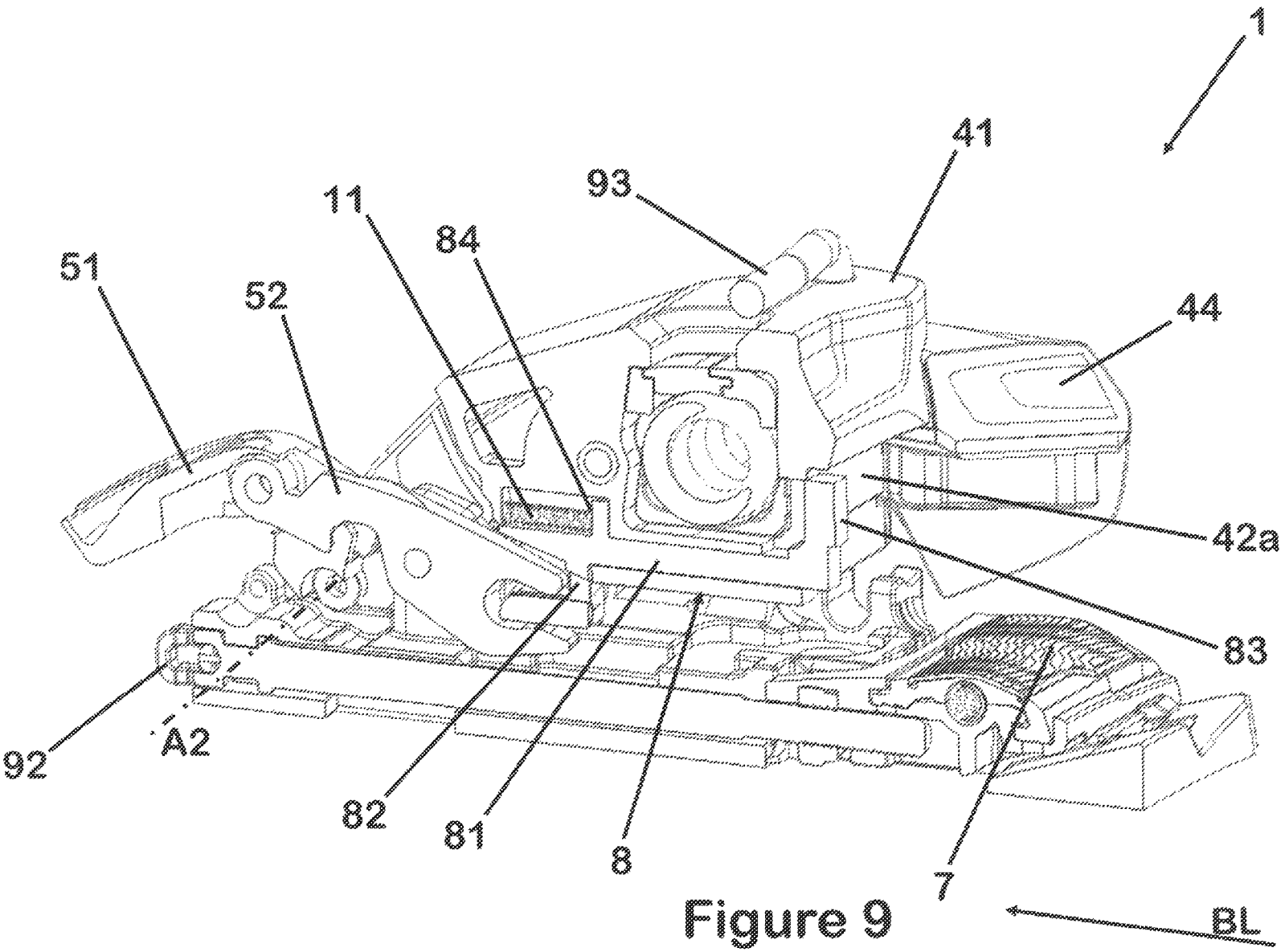
FIG. 9 a sectional view of the alternative front jaw of FIG. 8.

FIG. 8 shows the front jaw 1 comprising an additional latching element 8 (FIG. 9). The latching element 8 comprises an abutting area 83 for the front end of a sole of the ski boot which in the example embodiment is arranged centrally between the first ski boot retainer 43 and the second ski boot retainer 44. The abutting area 83 protrudes in front of an abutting area 42*a* of the holding device body 41 counter to the skiing direction, such that the abutting area 83 of the latching element 8 comes into contact with the front end of the sole of the ski boot before the latter comes to rest on the abutting area 42*a* of the holding device body 41. The latching element 8 is movably mounted in the holding device body 41 of the second holding device 4, such that the latching element 8 can be moved in the skiing direction into the holding device body 41 from a release position into a latching position.

The latching element 8 ensures that the engaging elements 31, 32 are not unintentionally released from the receptacles 47 in the configuration for descending, as long as a ski boot is situated in the front jaw 1. Additionally latching the engaging elements 31, 32 by actuating the tensioning lever 51, as described in the embodiment according to FIGS. 1 to 7, in the configuration for descending is therefore not necessary and accordingly also cannot be forgotten by the user.

FIG. 9 shows how the latching element 8 comprises a latching body 81, a stud 82 which protrudes from the latching body 81, the abutment 83 and an area 84 which serves as a counter bearing for a spring element 11 which biases the latching element 8 into the release position. The latching body 81, the stud 82, the abutment 83 and the area 84, which forms an abutment area for a spring element 11 which biases the latching element 8 into the relaxing position shown in FIG. 9, are formed as a single part in the example embodiment, as can clearly be seen in FIG. 9 which shows a section through the front jaw 1 along the longitudinal axis BL of the jaw.

Figure 10:
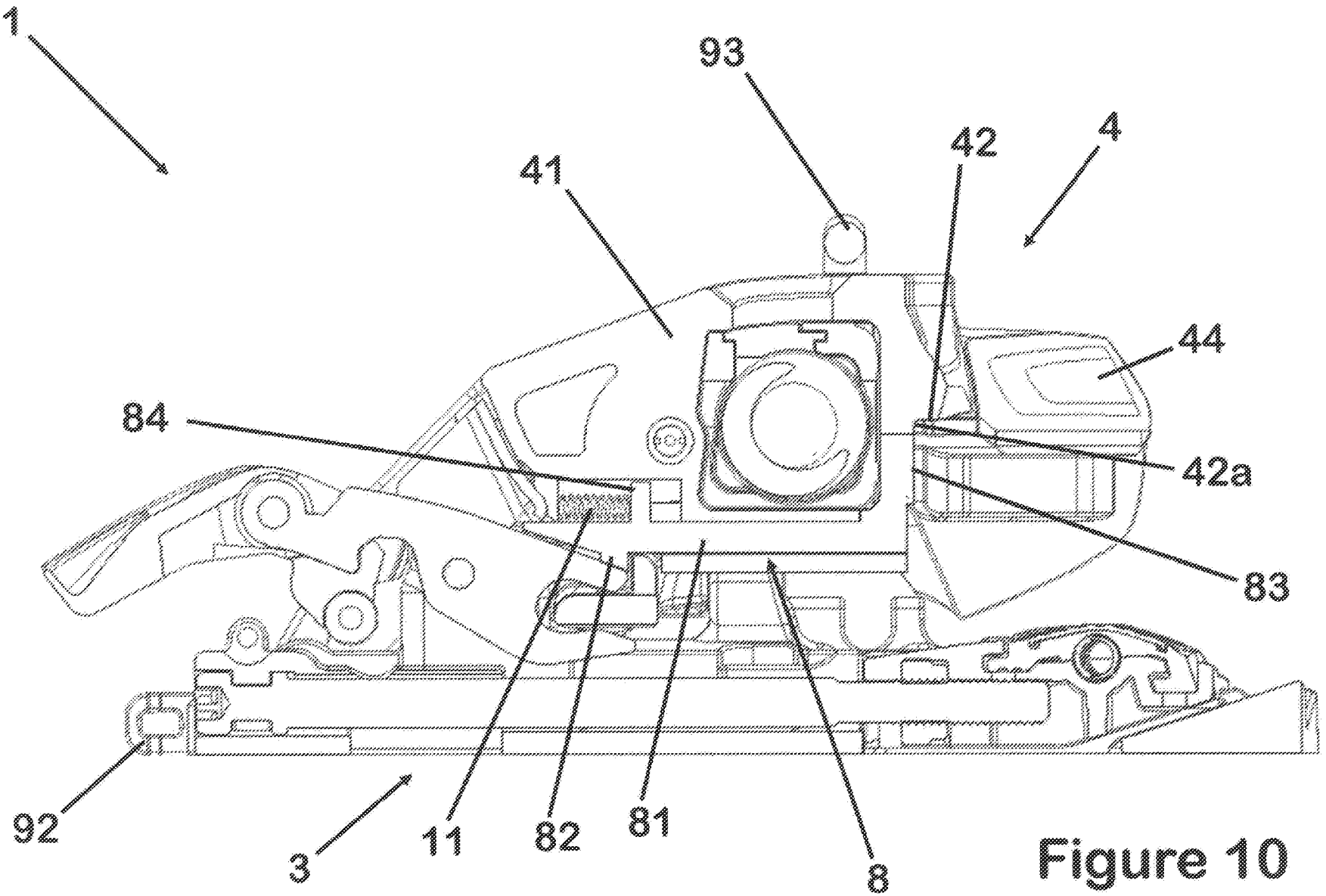
FIG. 10 a sectional view of the alternative front jaw of FIG. 8, comprising a latching element in a latching position.

If a user steps into the front jaw 1 of FIG. 8 wearing a ski boot, the front end of the sole of the ski boot initially comes into contact with the abutment 83 and displaces the latching element 8 in the skiing direction. This moves the stud 82 into a position in which it latches the tensioning device 5, i.e. prevents the tensioning device 5 or, respectively, the tensioning lever 51 from being able to be moved by hand or with the aid of the ski pole, in order to move the engaging elements 31, 32 of the first holding device 3 out of the receptacles 47 of the second holding device 4. This state, in which the latching element 8 has been moved into a latching position against the force of the spring element 11, is depicted in FIG. 10. The abutting area 83 of the latching element 8 and the abutting area 42*a* of the holding device body 41 are then in one plane, i.e. flush with each other. The stud 82 lies on a surface of the tensioning element 52 or directly above a surface of the tensioning element 52 facing it, such that the tensioning device 5 cannot be released.

Figure 11:
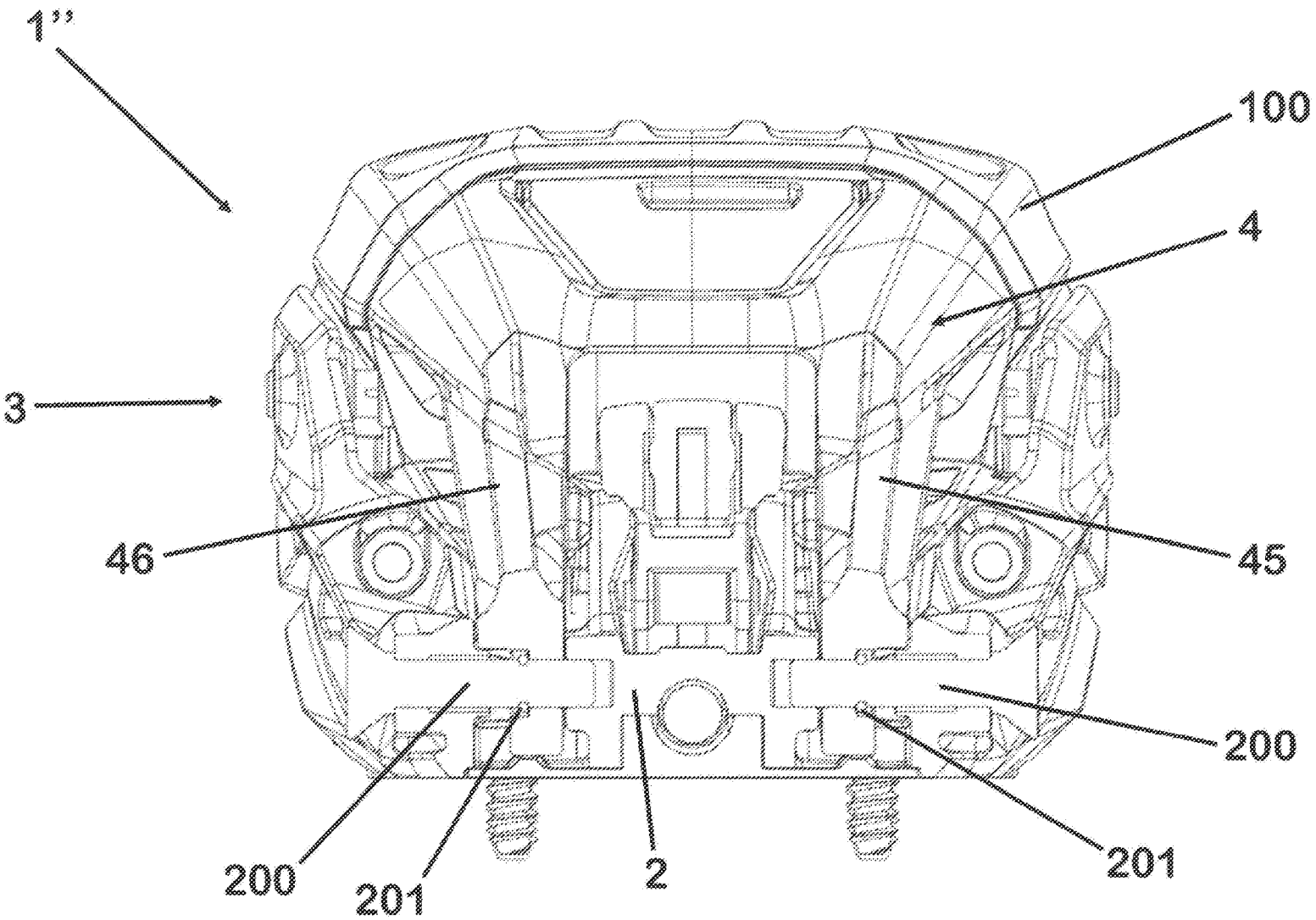
FIG. 11 an alternative front jaw comprising a first and second holding device and an alternative securing device comprising split pins in the released position.
Figure 12:
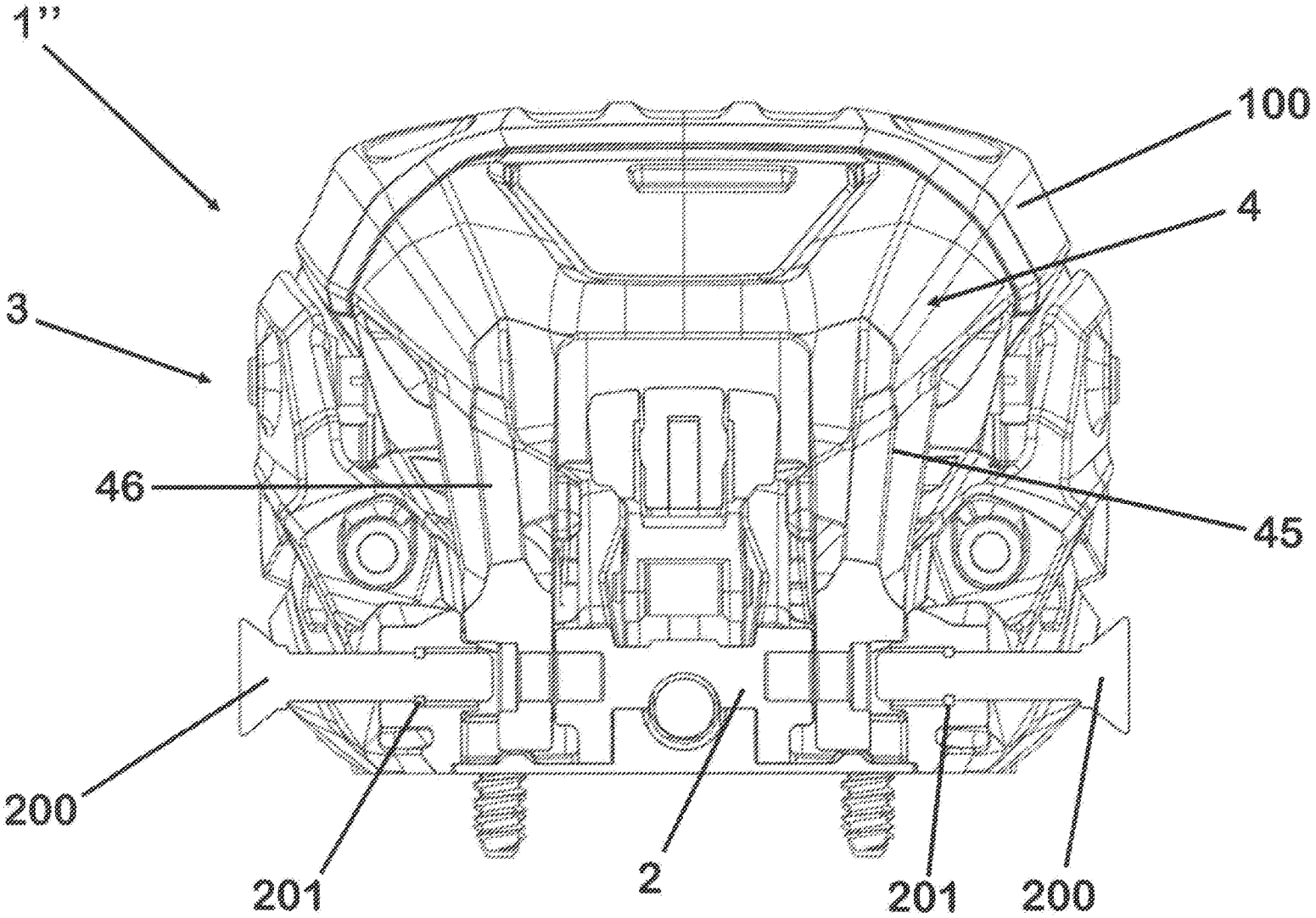
FIG. 12 the alternative front jaw of FIG. 11, with the securing device in the latched position.

FIGS. 11 and 12 show another front jaw 1" which exhibits an alternative solution to how the second holding device 4 can be connected to the base 2 such that it can be pivoted relative to the first holding device 3 in the longitudinal direction of the ski in order to change from a touring mode of the ski binding to a downhill mode. Two split pins 200 serve as connecting elements which are captively connected to the base 2 and can be moved from the first position shown in FIG. 11, in which they connect the second holding device 4 to the base 2 such that it can be pivoted, into the second position shown in FIG. 12, in which the second holding device 4 can be removed from the base 2, in order for example to reduce the weight of the ski for ascending in the touring mode. The split pins 200 are preferably moved into the first and second position by hand or less preferably with the aid of a tool. Each of the two split pins 200 comprises a snap ring 201 which secures it in the base 2, so that the split pin 200 does not unintentionally fall out of the guide in the base 2, wherein the movement of the split pin 200 can be a simple linear movement or a rotational movement, such as a screwing movement, or a combined movement in which the split pin 200 is linearly moved and is rotated either in the process or for example in one or both of its respective end positions in order to fix, i.e. secure, the split pin 200 in the respective end position in the base 2. The split pin 200 can be secured in the respective end position in a known way in a positive fit and/or force fit.

In order to connect the second holding device 4 to the base 2, the split pin 200 protrudes through a part of an outer housing of the base 2, through the second holding device 4 and then into another part of the base 2 which is formed between the two connecting arms 45, 46 of the second holding device 4.

Unlike the front jaw 1 of FIGS. 1 to 10, the front jaw 1" of FIGS. 11 and 12 comprises a bracket 100 which grips over the end of the second holding device 4 which faces the ski boot in the downhill mode of the ski binding. The bracket 100 for example forms a reinforcing element for the second holding device 4 and can be used as a snow wiper in order to remove snow from the lower side of the sole of the ski boot before stepping into the binding.

The invention claimed is:

1. A ski binding, comprising a front jaw for holding a front end of the sole of a ski boot and a rear jaw for holding a rear end of the sole of a ski boot, wherein the front jaw comprises:

a base, via which the front jaw can be connected to a ski;

a jaw body which is or can be connected to the base or forms part of the base;

a first holding device using which a ski boot can be connected to the ski at the front end of the ski boot for ascending, wherein the first holding device defines a joint axis about which the ski boot can be pivoted via its front end; and a second holding device using which the ski boot can be connected to the ski at the front end of the ski boot for descending, wherein the second holding device exhibits a first configuration for descending, in which the second holding device is in contact with the front end of the sole of the ski boot, and a second configuration for ascending, in which the second holding device is out of contact with the front end of the sole of the ski boot, wherein, in the first configuration for descending, the second holding device is coupled to the base and/or the first holding device, wherein the second holding device is embodied such that it can be temporarily removed from the base and/or the first holding device during ascent.

2. The ski binding according to claim 1, wherein the first holding device comprises at least a first and a second engaging element, which can be moved from a first position, in which they have a first distance from each other, towards each other into a second position in which they have a second distance from each other which is smaller than the first distance, wherein the first engaging element and the second engaging element can be moved into the second position and held in the second position by a tensioning device, and the second holding device comprises: a holding device body; a first ski boot retainer which encompasses the front end of the sole at least laterally, wherein the first ski boot retainer is connected to the holding device body in a first pivot joint; a second ski boot retainer which encompasses the front end of the sole at least laterally, wherein the second ski boot retainer is connected to the holding device body in a second pivot joint; at least one spring element which tensions the first ski boot retainer and the second ski boot retainer towards each other; and at least one connecting device which detachably connects the second holding device to the base and/or the first holding device.

3. The ski binding according to claim 2, wherein the connecting device comprises a first connecting arm, which is rigidly connected to or formed by the holding device body, and a second connecting arm which is rigidly connected to or formed by the holding device body, and the first connecting arm and the second connecting arm are arranged parallel to each other and spaced from each other.

4. The ski binding according to claim 2, wherein a free end of the connecting device comprises an engaging structure which co-operates with a complementary engaging structure which is comprised by the base or the jaw body, in order to detachably connect the second holding device to the first holding device, wherein the engaging structure and the complementary engaging structure form a pivot axis about which the second holding device can be pivoted relative to the first holding device.

5. The ski binding according to claim 1, wherein the second holding device has at least one receptacle opening with which a securing element can engage in order to fix the second holding device in the first configuration for descending, wherein the securing element is an engaging element of the first holding device.

6. The ski binding according to claim 4, wherein the second holding device also comprises a securing device which is connected to the holding device body such that it can be pivoted in at least one pivot joint or pivot axis, wherein the pivot axis extends substantially parallel to the joint axis.

7. The ski binding according to claim 6, wherein the securing device comprises at least one securing arm or a first securing arm, a second securing arm and a securing plate which connects the first securing arm and the second securing arm to each other at one end, and wherein a free end of the at least one securing arm or a free end of the first securing arm and the second securing arm each form an engagement, wherein each of the engagements can be connected to the complementary engaging structure of the base or jaw body.

8. The ski binding according to claim 6, wherein the at least one securing arm or the first securing arm and/or the second securing arm has/have an outwardly protruding molded part on a lower side facing the ski.

9. The ski binding according to claim 6, wherein the securing device is arranged between the first connecting arm and the second connecting arm.

10. The ski binding according to claim 1, wherein the front jaw also comprises a latching element which latches the tensioning device in the second position when a ski boot is being held in the second holding device.

11. The ski binding according to claim 10, wherein the latching element comprises: a latching body; a stud which protrudes from the latching body; an abutting area for a front end of a sole of the ski boot; and an area which serves as a counter bearing for a spring element; and wherein the abutting area is contacted by a front side of the sole of the ski boot when stepping into the ski binding wearing a ski boot, and the latching element can be moved from a release position into a latching position when stepping in further in the skiing direction.

12. The ski binding according to claim 11, wherein the spring element biases the latching element into the release position, and the latching element can be moved into the latching position against the force of the spring element, and wherein, in the latching position, the stud which protrudes from the latching body prevents the tensioning device from being able to be moved from the second position into the first position.

13. The ski binding according to claim 10, wherein the latching element is arranged between the first ski boot retainer and the second ski boot retainer and is guided linearly in the holding device body.

14. A front jaw attachment for a ski binding, comprising a second holding device according to claim 1.

15. The front jaw attachment according to claim 14, wherein the second holding device is designed to be detachably connected to the first holding device.

16. The ski binding according to claim 1, wherein the second holding device is temporarily removable by hand or with the aid of a ski pole.

* * * * *